US006932230B2

(12) United States Patent
Pedmo et al.

(10) Patent No.: US 6,932,230 B2
(45) Date of Patent: Aug. 23, 2005

(54) HOLLOW PLASTIC BOTTLE INCLUDING VACUUM PANELS

(75) Inventors: Marc A. Pedmo, Litchfield, OH (US); Richard C. Darr, Medina, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 10/642,320

(22) Filed: Aug. 15, 2003

(65) Prior Publication Data

US 2005/0035083 A1 Feb. 17, 2005

(51) Int. Cl.[7] ..... B65D 1/02; B65D 1/42
(52) U.S. Cl. ..... 215/381; 215/382; 220/672
(58) Field of Search ..... 215/373, 381–383, 215/379; 220/672, 675, 669

(56) References Cited

U.S. PATENT DOCUMENTS 4,598,831 A * 7/1986 Nakamura et al. ..... 215/373
5,238,129 A * 8/1993 Ota ..... 215/381
5,279,433 A * 1/1994 Krishnakumar et al. .... 215/381
5,337,909 A * 8/1994 Vailliencourt ..... 215/381
5,341,946 A * 8/1994 Vailliencourt et al. ..... 215/381
5,407,086 A * 4/1995 Ota et al. ..... 215/383
5,411,699 A * 5/1995 Collette et al. ..... 264/523
D413,519 S * 9/1999 Eberle et al. ..... D9/538
5,971,184 A * 10/1999 Krishnakumar et al. .... 215/384
6,016,932 A * 1/2000 Gaydosh et al. ..... 215/382
6,036,037 A * 3/2000 Scheffer et al. ..... 215/381
6,044,996 A * 4/2000 Carew et al. ..... 215/381
D433,946 S * 11/2000 Rollend et al. ..... D9/538

FOREIGN PATENT DOCUMENTS

GB 2161133 A * 1/1986 ..... B65D/1/44
WO WO97/34808 * 9/1997

* cited by examiner

*Primary Examiner*—Sue A. Weaver
(74) *Attorney, Agent, or Firm*—Robert H. Bachman

(57) ABSTRACT

The hollow plastic bottle includes a side wall with a plurality of spaced apart vacuum panels and top and bottom recessed cylindrical bands above and below the vacuum panels. The bottom band extends continuously around the circumference of the bottle, and the top band includes at least two spaced apart discontinuities comprising raised portions interrupting the continuity of the top band.

20 Claims, 3 Drawing Sheets

HOLLOW PLASTIC BOTTLE INCLUDING VACUUM PANELS

BACKGROUND OF THE INVENTION

The present invention relates to an improved hot fillable plastic container having an improved side wall construction.

The packaging of certain liquids requires that they be packaged while hot. During filling the container is subjected to elevated temperatures, the container is capped and as the product cools a negative internal pressure or hot fill vacuum is formed within the container. The container construction for a plastic container must be able to withstand such internal pressure changes while maintaining the container configuration.

Various constructions have been proposed for plastic containers in an effort to maintain the integrity of the container during hot fill operations. Thus, the hot fill containers have been produced with a generally cylindrical main body which is provided with a plurality of elongated vertically oriented panels. These panels, which are commonly referred to as pressure or vacuum panels, are designed to collapse inwardly after the container has been filled with a hot liquid so as to accommodate the inevitable volume shrinkage of the liquid in the container as the liquid cools. However, the inward flexing of the panels caused by the hot fill vacuum creates high stress points at the top and bottom edges of the pressure panels, and especially at the upper and lower corners of the panels. These stress points weaken the portions of the side wall near the edges of the panels, allowing the side wall to collapse inwardly during handling of the container or when containers are stacked together.

Numerous design changes have been proposed to overcome this problem, including but not limited to design variations in the vacuum panels, axially extending posts between the vacuum panels and circumferential ridges above and below the vacuum panels. However, despite these numerous designs it has been found that collapse under vacuum still occurs, especially in localized areas.

It is, therefore, a principal objective of the present invention to provide an improved design for a hot fillable plastic container that resists vacuum collapse.

It is a further objective of the present invention to provide an improved hot fillable plastic container as aforesaid which has an aesthetically pleasing design and is cost effective.

It is a further objective of the present invention to provide an improved plastic container as aforesaid which maintains its structural rigidity under hot fill conditions in a simple design which is readily prepared on a commercial scale.

Further objects and advantages of the present invention will appear hereinbelow.

SUMMARY OF THE INVENTION

In accordance with the present invention the foregoing objects and advantages are readily obtained.

The hollow plastic bottle of the present invention comprises: a hollow body of thermoplastic material having a generally cylindrical side wall, an upper end with a dispensing opening therein, and a lower supporting base, with an inwardly extending portion; said side wall including a plurality of circumferentially spaced apart vacuum panels and a plurality of elongated posts positioned between the panels; top and bottom recessed cylindrical bands above and below said vacuum panels; wherein said bottom band extends continuously around the circumference of said bottle, and wherein said top band includes at least two, spaced apart discontinuities comprising raised portions each of which interrupts the continuity of the top band.

Preferably, the top and bottom bands are each single bands, and preferably the discontinuities are each positioned over a vacuum panel and are spaced 180° apart.

Further features of the present invention will appear hereinbelow.

BRIEF DESCRIPTION OF THE DRAWINGS

The present invention will be more readily understandable from a consideration of the accompanying drawings, wherein.

DETAILED DESCRIPTION OF PREFERRED EMBODIMENTS

Figure 1:
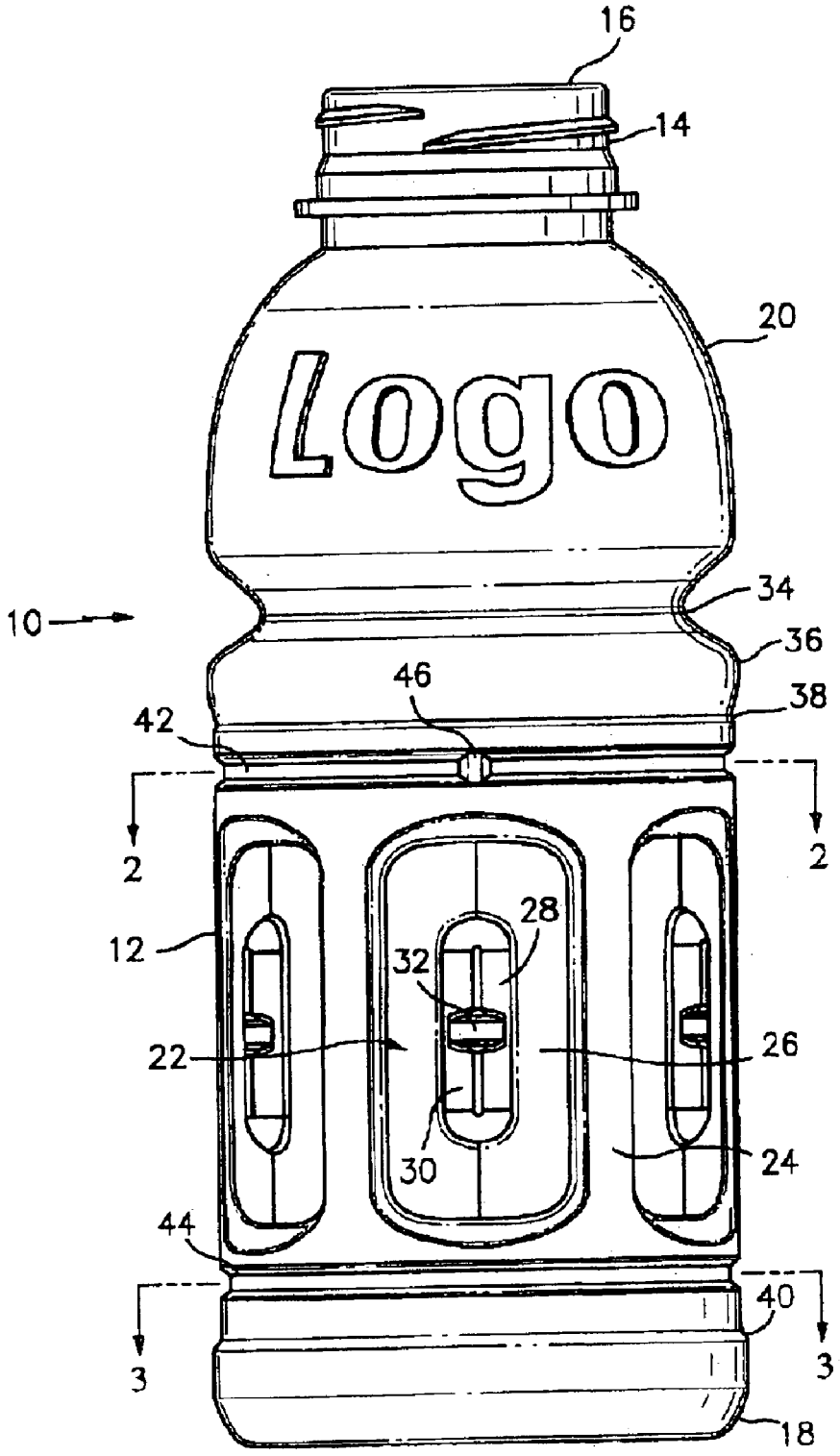
FIG. 1 is a side view of the bottle of the present invention.

Referring to the drawings, the container 10 of the present invention shown in FIG. 1 includes a side wall portion 12, an upper end 14 with a dispensing opening 16 therein, which may be threaded as shown, suitable for receiving a closure (not shown), and a base portion 18. A generally dome shaped portion 20 is located between the side wall portion 12 and the upper end 14.

Container 10 is a hot-fill, blow molded plastic container which is particularly suited to be filled with a liquid at an elevated temperature and subsequently sealed. As the liquid cools its volume decreases in the sealed container. The container is produced from a thermoplastic material, as polyethylene terephthalate (PET), high density polyethylene (HDPE), polyethylene naphthalate, polyvinyl chloride, and others.

The side wall 12 includes a plurality of vertically elongated vacuum panels 22 which are disposed about the circumference of the container and are spaced apart from each other by smooth, vertically elongated land areas 24. Preferably six of the vertically elongated panels 22 are provided.

Each panel 22 preferably includes a radially inwardly offset peripheral portion 26 which surrounds two central, outwardly extending vertical portions 28, 30 separated by a depressed portion 32. The length of the central, outwardly extending portions 28, 30 can be varied so, for example, they may be shorter or longer than as shown in FIG. 1. The inwardly offset or depressed peripheral portion 26 desirably has a curved upper and lower region as shown, and the depressed portion 32 is desirably located centrally on the elongated panels 22.

In the preferred embodiment, peripheral portion 26 includes a curved surface wherein the outer perimeter 26*a* is depressed further than the inner perimeter 26*b*, which surrounds two central, outwardly extending vertical portions 28, 30 separated by a depressed portion 32. This construction of peripheral portion 26 allows the two central, outwardly extending vertical portions 28, 30, separated by a depressed portion 32, to flex inwardly as the bottle cools from the initial hot fill of the container. The flexing of the two central, outwardly extending vertical portions 28, 30, separated by a depressed portion 32, allows for the container to maintain structural integrity as the vacuum is applied from the change in density of the product as it cools from the initial hot fill.

A recessed portion 34 is located between the dome shaped portion 20 and side wall 12, and a shoulder portion 36 including a lower edge 38 is located beneath the recessed portion 34. The lower edge 38 of the shoulder portion 36 defines an upper label bumper. The upper edge 40 of the base portion 18 defines a lower label bumper. A full wrap label (not shown) may then be applied and secured to side wall 12 between the upper and lower label bumpers, as is known in the art.

The dome shaped portion 20 may if desired include a logo or trademark thereon as shown in FIG. 1, and may also include one or more pressure relief formations in addition to or instead of a logo or trademark.

In accordance with the present invention the container side wall 12 includes a top 42 and bottom 44 recessed cylindrical bands above and below the vacuum panels 22 and both within the label mounting area. The bottom band 44 extends continuously around the circumference of the bottle as clearly shown in FIG. 3. On the other hand, the top band 42 includes at least two spaced apart discontinuities 46, 48 as clearly shown in FIG. 2. The discontinuities 46, 48 are raised portions which interrupt the continuity of the top band 42 and separate the top band into two separate, discontinuous bands. The discontinuities are desirably located over the central portion of a vacuum panel as clearly shown in FIG. 1. Greater than two discontinuities may be used separating the top band into more than two separate, discontinuous bands, as for example, four or six discontinuities. If greater than two discontinuities are provided each should preferably be located over a vacuum panel and desirably over the central portion of a vacuum panel.

Base 18 desirably includes an inwardly extending central portion 50, a peripheral rim 52 to support the bottle when standing, and radially extending, outwardly disposed spokes or struts 54 extending between the central portion and peripheral rim, although different base configurations can be used. Preferably, 6 to 10 of the spokes or struts are provided, and they are preferably uniformly spaced around the central portion of the base.

Figure 2:
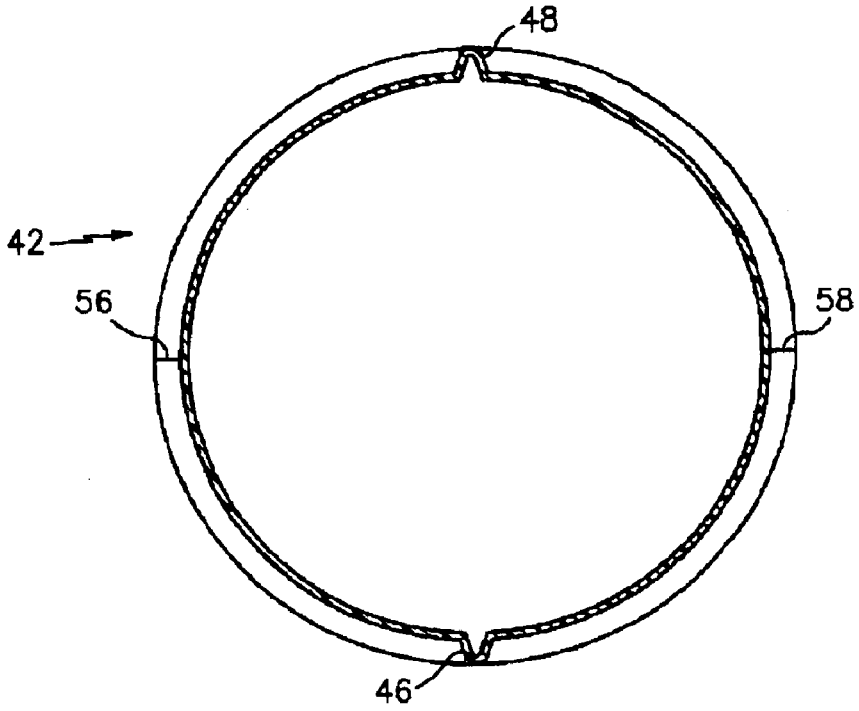
FIG. 2 is a sectional view along line 2—2 of FIG. 1.
Figure 3:
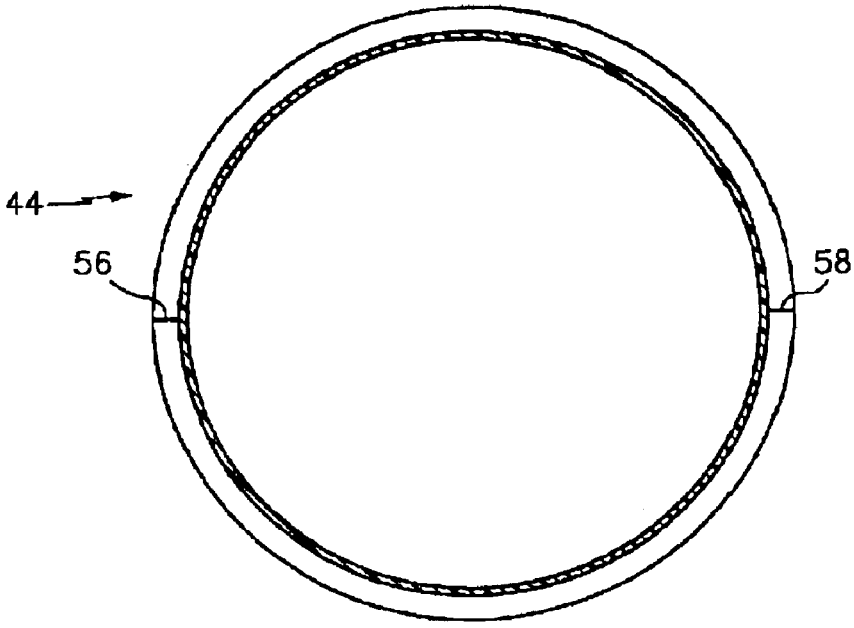
FIG. 3 is a sectional view along line 3—3 of FIG. 1.
Figure 4:
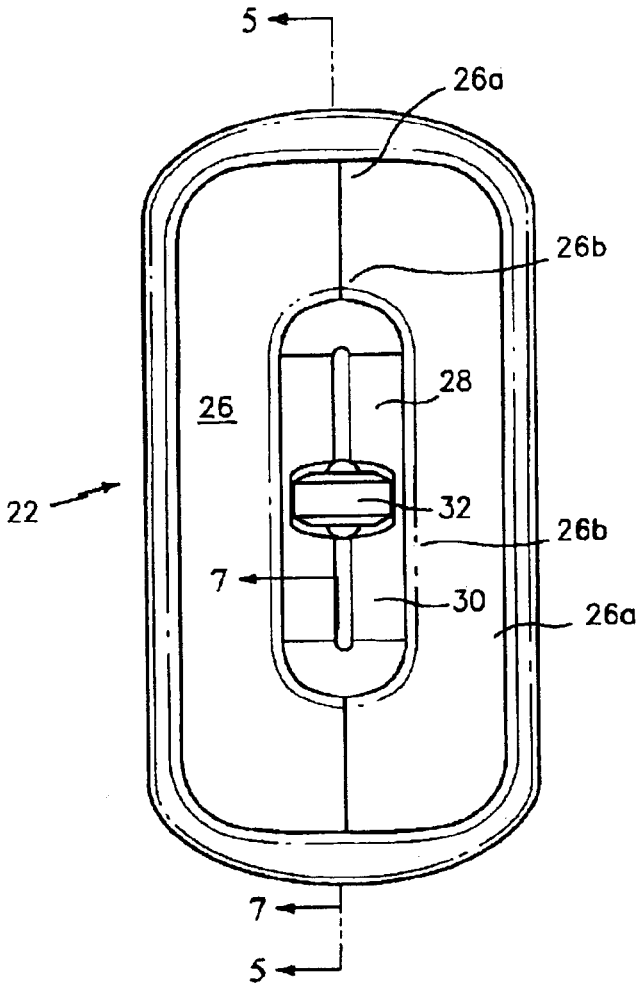
FIG. 4 is an enlarged elevational view of a vacuum panel from the bottle of FIG. 1.
Figure 5:
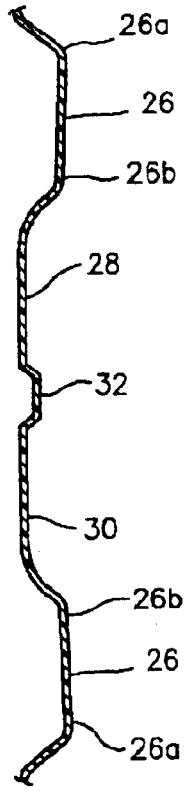
FIG. 5 is a sectional view along line 5—5 of FIG. 4.
Figure 6:
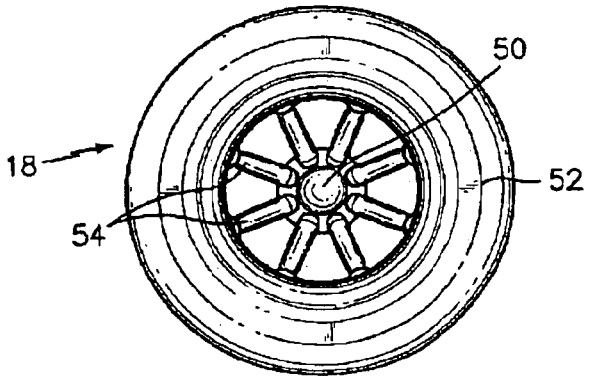
FIG. 6 is a bottom view of the bottle of FIG. 1.
Figure 7:
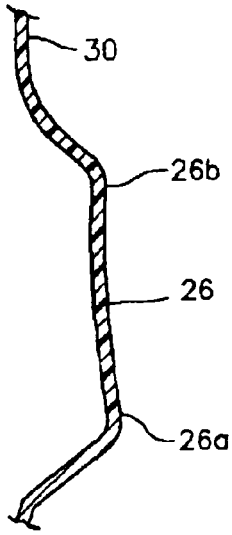
FIG. 7 is a sectional view along line 7—7 of FIG. 4.

In accordance with the present invention the construction provides greater support and makes the bottles desirably rigid in a hot fill situation, particularly when the bottle includes a parting line as parting lines 56, 58 shown in FIGS. 2 and 3. Where two discontinuities 46, 48 are provided they are preferably each situated 90° from the parting lines as shown in FIGS. 2 and 3 in order to provide improved side wall strength. The discontinuities of the present invention provide strengthening for the upper portion of the bottle. The construction of the present invention advantageously provides more uniform flexing in the vacuum panels in a hot fill situation.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A hollow plastic bottle, which comprises:

a hollow body of thermoplastic material having a generally cylindrical side wall, an upper end with a dispensing opening therein, and a lower supporting base with an inwardly extending portion;

said side wall including a plurality of circumferentially spaced apart, vacuum panels and a plurality of elongated posts positioned between the panels;

top and bottom elongated recessed cylindrical bands above and below said vacuum panels;

and wherein said bottom elongated band extends continuously around the circumference of said bottle, and wherein said top elongated band includes at least two spaced apart discontinuities comprising raised portions each of which interrupts the continuity of the top band, wherein said discontinuities are each positioned over the central portion of an adjacent vacuum panel and the top band extends over the major portion of said adjacent vacuum panel, and wherein more uniform flexing is provided in the vacuum panels.

2. A bottle according to claim 1, including two of said discontinuities spaced 180° apart.

3. A bottle according to claim 1, including a generally dome shaped portion located between the upper end and side wall.

4. A bottle according to claim 3, including six of said spaced apart vacuum panels.

5. A bottle according to claim 4, wherein said elongated posts comprise smooth, vertically elongated land areas which space apart each vacuum panel from each other.

6. A bottle according to claim 3, including a recessed portion between the dome shaped portion and the side wall.

7. A bottle according to claim 6, including a shoulder with a lower edge beneath the recessed portion.

8. A bottle according to claim 7, wherein the lower edge of the shoulder defines an upper label bumper, and an upper edge of the base defines a lower label bumper.

9. A bottle according to claim 1, wherein each vacuum panel includes an inwardly offset peripheral portion.

10. A bottle according to claim 9, wherein said inwardly offset peripheral portion surrounds two central, outwardly extending vertical portions separated by a depressed portion.

11. A bottle according to claim 10, wherein said inwardly offset peripheral portion has a curved surface and wherein the depressed portion is located centrally on said vacuum portions.

12. A bottle according to claim 1, including single top and bottom recessed bands and a label mounting area covering said vacuum panels and top and bottom recessed bands.

13. A bottle according to claim 1, including an inwardly extending central portion of the base, a peripheral base rim to support the bottle when standing, and radially extending, outwardly disposed spokes extending between the central portion of the base and the peripheral rim.

14. A bottle according to claim 1, wherein the thermoplastic material is polyethylene terephthalate.

15. A bottle according to claim 1, wherein said bottle is a hot fill container.

16. A bottle according to claim 15, wherein said bottle is a blow molded, plastic bottle.

17. A bottle according to claim 1, wherein said vacuum panels are vertically elongated and disposed about the circumference of said side wall.

18. A bottle according to claim 1, wherein said discontinuities are located entirely over the central portion of an adjacent vacuum panel.

19. A hollow plastic bottle, which comprises:

a hollow body of thermoplastic material having a generally cylindrical side wall, an upper end with a dispensing opening therein, and a lower supporting base with an inwardly extending portion;

said side wall including a plurality of circumferentially spaced apart, vacuum panels and a plurality of elongated posts positioned between the panels;

top and bottom recessed cylindrical bands above and below said vacuum panels;

and wherein said bottom band extends continuously around the circumference of said bottle, wherein said top band includes at least two spaced apart discontinuities comprising raised portions each of which interrupts the continuity of the top band, wherein the bottle includes a parting line and wherein the discontinuities are each 90° from the parting line.

20. A hollow plastic bottle which comprises:

a hollow body of thermoplastic material having a generally cylindrical side wall, an upper end with a dispensing opening therein, and a lower supporting base with an inwardly extending portion;

said side wall including a plurality of circumferentially spaced apart, vacuum panels and a plurality of elongated posts positioned between the panels, wherein each vacuum panel includes an inwardly offset peripheral portion which includes an outer perimeter and an inner perimeter, with the outer perimeter of said offset peripheral portion depressed further than the inner perimeter, and top and bottom elongated recessed cylindrical bands above and below said vacuum panels;

and wherein said bottom elongated band extends continuously around the circumference of said bottle, and wherein said top elongated band includes at least two spaced apart discontinuities comprising raised portions each of which interrupts the continuity of the top band.

* * * * *